US009347391B2

(12) United States Patent
Nanba et al.

(10) Patent No.: US 9,347,391 B2
(45) Date of Patent: May 24, 2016

(54) AIR-FUEL RATIO CONTROL DEVICE FOR INTERNAL COMBUSTION ENGINE FOR OUTBOARD MOTOR, AIR-FUEL RATIO CONTROL METHOD, AND PROGRAM PRODUCT

(71) Applicant: SUZUKI MOTOR CORPORATION, Hamamatsu-shi, Shizuoka (JP)

(72) Inventors: Masahiro Nanba, Hamamatsu (JP); Tomohiko Miyaki, Hamamatsu (JP); Hitoshi Matsumura, Mamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 696 days.

(21) Appl. No.: 13/687,062

(22) Filed: Nov. 28, 2012

(65) Prior Publication Data

US 2013/0166174 A1 Jun. 27, 2013

(30) Foreign Application Priority Data

Nov. 30, 2011 (JP) ..... 2011-262260

(51) Int. Cl.
*F02D 41/00* (2006.01)
*F02D 41/24* (2006.01)
*F02D 41/14* (2006.01)

(52) U.S. Cl.
CPC ..... *F02D 41/00* (2013.01); *F02D 41/2448* (2013.01); *F02D 41/2454* (2013.01); *F02D 41/1475* (2013.01)

(58) Field of Classification Search
CPC ..... F02D 41/1475; F02D 41/2448; F02D 41/2454; F02D 41/2461
See application file for complete search history.

(56) References Cited

U.S. PATENT DOCUMENTS

| | | | | |
|---|---|---|---|---|
| 4,445,481 | A | 5/1984 | Aoki et al. | |
| 5,213,088 | A * | 5/1993 | Harada | 123/674 |
| 5,337,557 | A * | 8/1994 | Toyoda | 60/276 |
| 5,426,935 | A * | 6/1995 | Ogawa et al. | 60/276 |

(Continued)

FOREIGN PATENT DOCUMENTS

| | | |
|---|---|---|
| JP | 57105530 | 7/1982 |
| JP | H07-279722 | 10/1995 |

(Continued)

OTHER PUBLICATIONS

Japanese Office Action dated Jan. 6, 2015, which issued during prosecution of Japanese Application No. 2011-262260, which corresponds to the present application.

*Primary Examiner* — Erick Solis
*Assistant Examiner* — Anthony L Bacon
(74) *Attorney, Agent, or Firm* — Troutman Sanders LLP

(57) ABSTRACT

An air-fuel ratio control device has an open loop controller which controls an air-fuel ratio to be a target air-fuel ratio, a feedback controller that shifts the target air-fuel ratio to a logical air-fuel ratio, and feedback controls the air-fuel ratio to be the logical air-fuel ratio by using a feedback correction coefficient determined based on an output of an $O_2$ sensor, an average value calculator that calculates an average value of the feedback correction coefficient when the output of the $O_2$ sensor reverses from a lean side to a rich side and from the rich side to the lean side in a feedback control by the feedback controller, and a learned value calculator that calculates a learned value based on the average value at a time when the average value calculated by the average value calculator becomes substantially constant.

8 Claims, 9 Drawing Sheets

(56) References Cited

U.S. PATENT DOCUMENTS

| | | | | |
|---|---|---|---|---|
| 5,638,800 | A * | 6/1997 | Furuya | F02D 41/2454 123/674 |
| 6,014,963 | A * | 1/2000 | Narita | 123/674 |
| 6,230,699 | B1 * | 5/2001 | Mitsutani | F02D 41/0042 123/674 |
| 6,298,839 | B1 * | 10/2001 | Muto | F02D 41/1456 123/672 |
| 6,349,710 | B1 * | 2/2002 | Kawai | F02D 41/22 123/443 |
| 6,367,459 | B1 * | 4/2002 | Yoshioka | F02D 41/0035 123/516 |
| 2001/0011540 | A1 * | 8/2001 | Mashiki | 123/520 |
| 2005/0072139 | A1 * | 4/2005 | Kato | 60/285 |
| 2006/0185656 | A1 * | 8/2006 | Miyauchi et al. | 123/674 |
| 2006/0207558 | A1 * | 9/2006 | Tahara | 123/431 |
| 2012/0185156 | A1 * | 7/2012 | Iwazaki et al. | 701/104 |
| 2012/0290192 | A1 * | 11/2012 | Okazaki et al. | 701/103 |

FOREIGN PATENT DOCUMENTS

| | | |
|---|---|---|
| JP | H10-184421 | 7/1998 |
| JP | 2004-116371 | 4/2004 |
| JP | 2005-076529 | 3/2005 |
| JP | 2006-226234 | 8/2006 |
| JP | 2010-127174 | 6/2010 |

* cited by examiner

AIR-FUEL RATIO CONTROL DEVICE FOR INTERNAL COMBUSTION ENGINE FOR OUTBOARD MOTOR, AIR-FUEL RATIO CONTROL METHOD, AND PROGRAM PRODUCT

CROSS-REFERENCE TO RELATED APPLICATIONS

This application is based upon and claims the benefit of priority of the prior Japanese Patent Application No. 2011-262260, filed on Nov. 30, 2011, the entire contents of which are incorporated herein by reference.

BACKGROUND OF THE INVENTION

1. Field of the Invention

The present invention relates to an air-fuel ratio control device for an internal combustion engine for an outboard motor, an air-fuel ratio control method, and a program product. The present invention is particularly preferred when used for controlling an air-fuel ratio of the internal combustion engine for an outboard motor to be a predetermined air-fuel ratio on a lean side.

2. Description of the Related Art

Conventionally, when it is attempted to control an air-fuel ratio of an internal combustion engine, an air-fuel ratio sensor and an $O_2$ sensor disposed in an exhaust system of the internal combustion engine are used. The air-fuel ratio sensor is able to detect the air-fuel ratio accurately in a wider range than the $O_2$ sensor, but is more expensive than the $O_2$ sensor and causes increase in cost of the internal combustion engine. On the other hand, the $O_2$ sensor is less expensive than the air-fuel ratio sensor but is able to detect the air-fuel ratio only in the vicinity of a logical air-fuel ratio. Specifically, the $O_2$ sensor is only able to detect whether the actual air-fuel ratio of the internal combustion engine is on a lean side or a rich side from the logical air-fuel ratio.

On the other hand, in order to improve fuel consumption, the engine is operated with the air-fuel ratio being changed to a predetermined air-fuel ratio on a lean side from the logical air-fuel ratio in some cases. In such cases, when the actual air-fuel ratio is the predetermined air-fuel ratio on the lean side, it is possible to improve the fuel consumption, but due to dispersion of parts such as injectors for example, the actual air-fuel ratio may be displaced from the predetermined air-fuel ratio on the lean side. However, the $O_2$ sensor only detects whether the actual air-fuel ratio is on the lean side or the rich side from the logical air-fuel ratio as described above, and it is not able to detect whether or not the actual air-fuel ratio is at the predetermined air-fuel ratio on the lean side.

Regarding such problems, in Patent Document 1, the logical air-fuel ratio is taken as a target air-fuel ratio for operation, and the displacement from the actual air-fuel ratio is corrected using the $O_2$ sensor while calculating a feedback correction coefficient by feedback control. Next, a learning correction coefficient is calculated from the feedback correction coefficient, and open loop control is performed by applying the calculated learning correction coefficient, so as to control the actual air-fuel ratio to be a predetermined air-fuel ratio on a lean side. Therefore, by the air-fuel ratio control for the internal combustion engine described in Patent Document 1, it is possible to control the actual air-fuel ratio of the internal combustion engine to be the predetermined air-fuel ratio on the lean side even by using the $O_2$ sensor, thereby achieving improvement in fuel consumption.

Patent Document 1: Japanese Laid-open Patent Publication No. 57-105530

The outboard motor can be mounted on various types of hulls, which is different from vehicles such as motorcycles and automobiles. For example, the outboard motor can be mounted on a high-speed vessel or heavy vessel, or plural outboard motors are mounted on one hull in some cases. Thus, when the use environment is different, there occurs a displacement of the actual air-fuel ratio from the target air-fuel ratio in the internal combustion engine.

Further, alcohol-mixed gasoline as fuel for internal combustion engines is increasingly used particularly in other countries. The logical air-fuel ratio differs between genuine gasoline and alcohol-mixed gasoline, and thus a fuel injection amount and so on for the internal combustion engine differ as well. Therefore, also when the fuel is changed from the genuine gasoline to the alcohol-mixed gasoline, the displacement of the actual air-fuel ratio from the target air-fuel ratio occurs in the internal combustion engine.

When the operation continues while the actual air-fuel ratio is displaced from the target air-fuel ratio as described above, it is possible that the improvement in fuel consumption is not achieved or that it causes an unpleasant sensation in operational feeling of the boat operator. Therefore, it is desired that the learning correction coefficient is calculated early and the calculated learning correction coefficient is applied, so that the actual air-fuel ratio matches the target air-fuel ratio in a short time. On the other hand, when importance is placed only on calculation of the learning correction coefficient early and an inaccurate learning correction coefficient is applied, the original object to match the actual air-fuel ratio with the target air-fuel ratio is impaired.

SUMMARY OF THE INVENTION

The present invention is made in view of the above-described problems, and it is an object thereof to correct a displacement of an actual air-fuel ratio from a target air-fuel ratio accurately in a short time.

An air-fuel ratio control device of an internal combustion engine for an outboard motor according to the present invention is an air-fuel ratio control device which controls an air-fuel ratio of an internal combustion engine for an outboard motor provided with an $O_2$ sensor, which is disposed in an exhaust system of the internal combustion engine and varies in output characteristics in a vicinity of a logical air-fuel ratio, and has: means for open loop controlling which controls the air-fuel ratio to be a target air-fuel ratio based on an operating state of the internal combustion engine and a learned value; means for feedback controlling which shifts the target air-fuel ratio to a logical air-fuel ratio from a state that the target air-fuel ratio is controlled to be a predetermined air-fuel ratio on a lean side by the means for open loop controlling, and feedback controls the air-fuel ratio to be the logical air-fuel ratio by using a feedback correction coefficient determined based on an output of the $O_2$ sensor; means for calculating an average value which calculates the average value of the feedback correction coefficient when the output of the $O_2$ sensor reverses from a lean side to a rich side and from the rich side to the lean side in the feedback control by the means for feedback controlling; and means for calculating the learned value which calculates the learned value based on an average value at a time when the average value calculated by the means for calculating the average value becomes substantially constant.

Further, an air-fuel ratio control method according to the present invention is an air-fuel ratio control method which controls an air-fuel ratio of an internal combustion engine for an outboard motor provided with an $O_2$ sensor, which is disposed in an exhaust system of the internal combustion engine and varies in output characteristics in a vicinity of a logical air-fuel ratio, and has: an open loop control step of controlling the air-fuel ratio to be a target air-fuel ratio based on an operating state of the internal combustion engine and a learned value; a feedback control step of shifting the target air-fuel ratio to a logical air-fuel ratio from a state that the target air-fuel ratio is controlled to be a predetermined air-fuel ratio on a lean side by the open loop control step, and feedback controlling the air-fuel ratio to be the logical air-fuel ratio by using a feedback correction coefficient determined based on an output of the $O_2$ sensor; an average value calculating step of calculating an average value of the feedback correction coefficient when the output of the $O_2$ sensor reverses from a lean side to a rich side and from the rich side to the lean side in the feedback control step; and a learned value calculating step of calculating the learned value based on an average value at a time when the average value calculated by the average value calculating step becomes substantially constant.

Further, a program product according to the present invention is a program product for controlling an air-fuel ratio of an internal combustion engine for an outboard motor provided with an $O_2$ sensor, which is disposed in an exhaust system of the internal combustion engine and varies in output characteristics in a vicinity of a logical air-fuel ratio, and causes a computer to execute: an open loop control step of controlling the air-fuel ratio to be a target air-fuel ratio based on an operating state of the internal combustion engine and a learned value; a feedback control step of shifting the target air-fuel ratio to a logical air-fuel ratio from a state that the target air-fuel ratio is controlled to be a predetermined air-fuel ratio on a lean side by the open loop control step, and feedback controlling the air-fuel ratio to be the logical air-fuel ratio by using a feedback correction coefficient determined based on an output of the $O_2$ sensor; an average value calculating step of calculating an average value of the feedback correction coefficient when the output of the $O_2$ sensor reverses from a lean side to a rich side and from the rich side to the lean side in the feedback control step; and a learned value calculating step of calculating the learned value based on an average value at a time when the average value calculated by the average value calculating step becomes substantially constant.

DETAILED DESCRIPTION OF THE PREFERRED EMBODIMENTS

Hereinafter, embodiments according to the present invention will be described with reference to the drawings.

Figure 1:
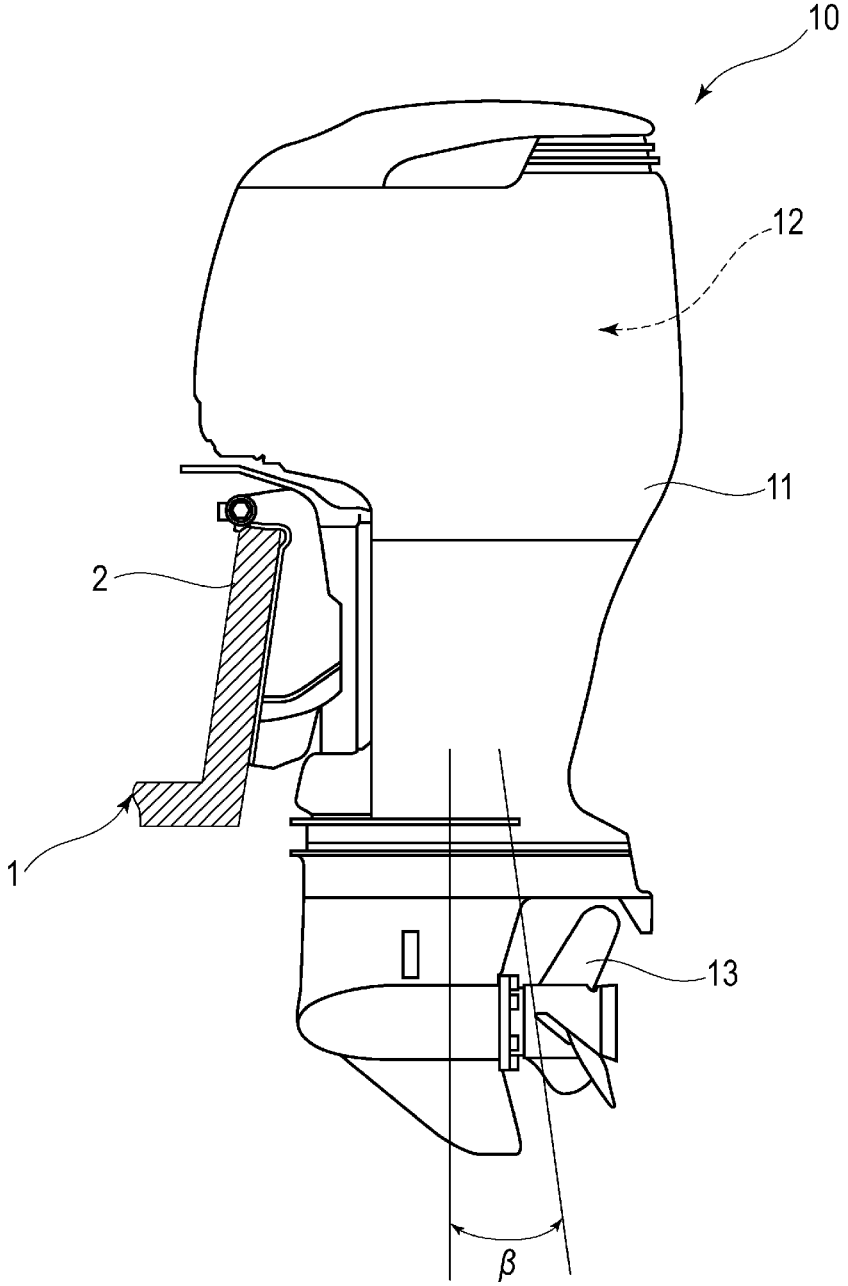
FIG. 1 is an exterior view of an outboard motor.

FIG. 1 is an exterior view of an outboard motor. As illustrated in FIG. 1, an outboard motor 10 is attached to a transom board 2 of a hull 1. The outboard motor 10 is covered entirely by a cover 11, and is thereby structured to have a trimmed shape. Inside this cover 11, an engine 12 as an internal combustion engine for an outboard motor is housed. Further, a screw 13 for propelling a hull 1 with the engine 12 being motive power is disposed in a lower portion of the outboard motor 10. Note that as the engine 12 according to this embodiment, a water-cooled, four-cycle V6 engine is employed.

Figure 2:
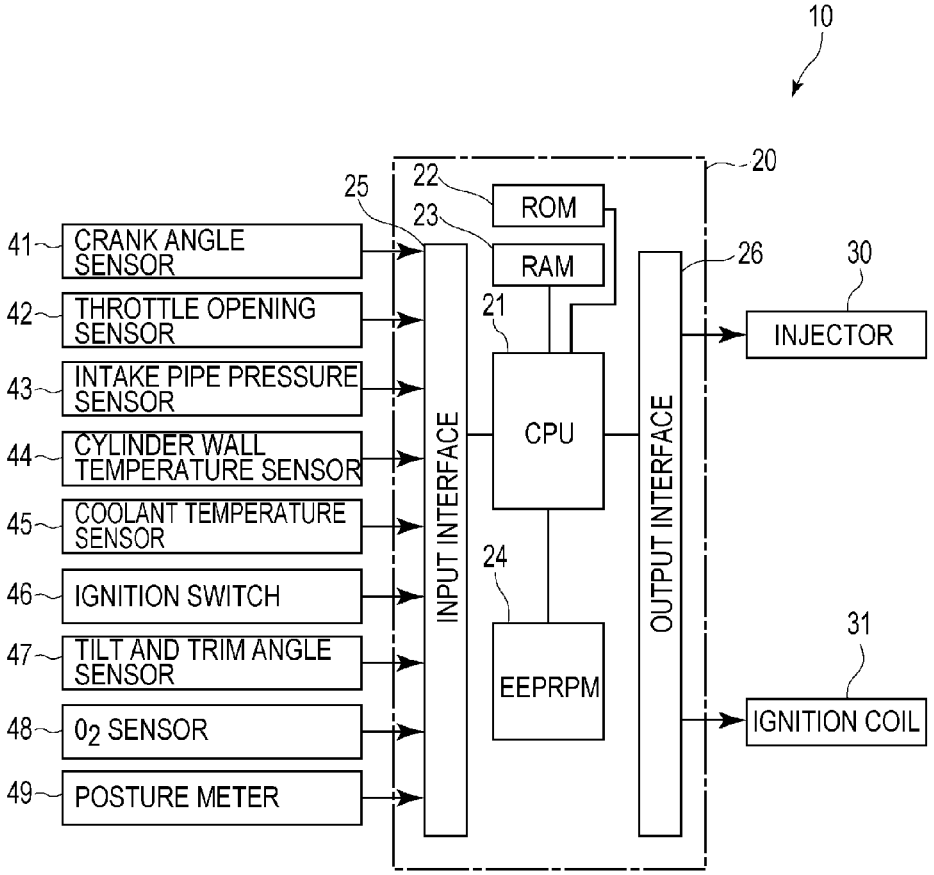
FIG. 2 is a block diagram illustrating an internal structure of the outboard motor.

FIG. 2 is a block diagram illustrating an internal structure of the outboard motor. The outboard motor 10 has an engine control unit 20 as a computer controlling various types of component devices. The engine control unit 20 is an air-fuel ratio control device according to the present invention, and is structured to include a CPU 21, a ROM 22, a RAM 23, an EEPROM 24, an input interface 25, and an output interface 26.

The CPU 21 executes a program product stored in the ROM 22, and controls an air-fuel ratio via injectors 30 based on signals outputted from various sensors or the like. The ROM 22 is a non-volatile memory and stores the program product executed by the CPU 21 and initial values, thresholds, and so on used when the CPU 21 controls various devices. The RAM 23 is a volatile memory and temporarily stores information or the like calculated when the CPU 21 controls various devices. The EEPROM 24 is a non-volatile memory as a rewritable storage unit, and stores information or the like, for example a learned value for controlling the air-fuel ratio, used when the CPU 21 controls various devices.

The input interface 25 is an input circuit receiving signals outputted from a crank angle sensor 41, a throttle opening sensor 42, an intake pipe pressure sensor 43, a cylinder wall temperature sensor 44, a coolant temperature sensor 45, an ignition switch 46, a tilt and trim angle sensor 47, an $O_2$ sensor 46, a posture meter 49, and so on, as illustrated in FIG. 2.

The crank angle sensor 41 is disposed in the vicinity of a crank shaft (not illustrated) of respective cylinders, and outputs a signal at a predetermined crank angle. Note that the CPU 21 can detect the engine speed by counting the signal outputted from the crank angle sensor 41.

Further, in response to an operation of a throttle lever by a boat operator, a throttle valve (not illustrated) disposed on an intake pipe (not illustrated) is opened or closed to adjust an air amount supplied to the engine 12. At this time, the throttle opening sensor 42 outputs a signal corresponding to the opening of the throttle valve.

The intake pipe pressure sensor 43 is disposed on the intake pipe and outputs a signal of an intake pipe internal pressure.

The cylinder wall temperature sensor 44 outputs a signal of the temperature of a cylinder block (not illustrated) of the engine 12.

The coolant temperature sensor 45 outputs a signal of the temperature of the coolant.

The ignition switch 46 is structured to be selectable between on and off by the boat operator, where being on allows power to be supplied to respective devices and being off cuts off the power to the respective devices.

The tilt and trim angle sensor 47 detects a trim angle β of the outboard motor 10 relative to the hull 1 as illustrated in FIG. 1 and outputs a signal.

The $O_2$ sensor 48 is disposed on an exhaust system of the engine 12, and generates an output which varies in characteristics in the vicinity of the logical air-fuel ratio. Specifically, the $O_2$ sensor 48 outputs a signal indicating whether the actual air-fuel ratio of the engine 12 is on a lean side or a rich side from the logical air-fuel ratio.

Figure 3:
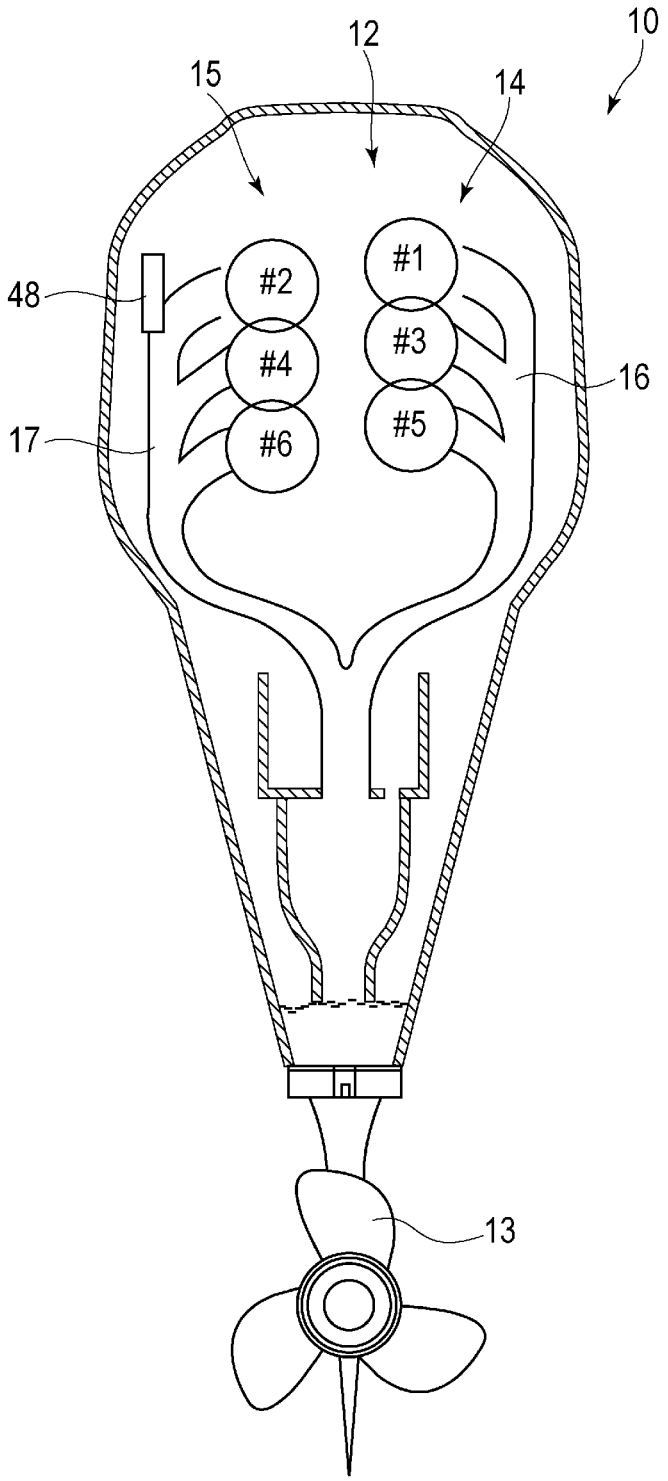
FIG. 3 is a schematic diagram of the outboard motor illustrating a position where an $O_2$ sensor is disposed.

FIG. 3 is a schematic diagram of the outboard motor illustrating the position where the $O_2$ sensor 48 is disposed, seeing the outboard motor from a rear side. In this embodiment, as described above, the V6 engine 12 is used. The V engine has plural cylinders in the cylinder block, which are disposed in a V-shape at a predetermined bank angle about the crank shaft (not illustrated). In the engine 12 of this embodiment, among six cylinders, three cylinders (#1, #3, #5) are disposed on a right bank 14, and three cylinders (#2, #4, #6) are disposed on a left bank 15.

An exhaust pipe 16 is connected to the right cylinders (#1, #3, #5), and an exhaust pipe 17 is connected to the left cylinders (#2, #4, #6). The exhaust pipe 16 and the exhaust pipe 17 are extended downward of the outboard motor 10, coupled substantially at a center of the outboard motor 10, and extended further downward. Exhaust gases exhausted from the respective cylinders are exhausted into water via the respective exhaust pipes 16, 17.

In the engine 12 according to this embodiment, the $O_2$ sensor 48 is disposed on the exhaust pipe 17 and at a position in the vicinity of the cylinder #2. Therefore, the $O_2$ sensor 48 mainly detects whether the air-fuel ratio of the exhaust gas exhausted by the cylinder #2 is on the lean side or the rich side from the logical air-fuel ratio. However, in this embodiment, the exhaust gases of the three cylinders (#2, #4, #6) on the left bank 15 are exhausted by the common exhaust pipe 17. Therefore, the $O_2$ sensor 48 detects, although less influenced than the cylinder #2, the air-fuel ratio of an exhaust gas containing exhaust gases of the cylinders (#4, #6). In this manner, the $O_2$ sensor 48 is disposed only on an exhaust system of cylinders disposed on one bank. That is, the $O_2$ sensor 48 is structured to be capable of detecting the air-fuel ratio of the exhaust gas of one cylinder among the plural cylinders disposed in the engine 12.

The posture meter 49 is, for example, a gyro sensor, and detects the posture of the outboard motor 10 and outputs a signal.

Further, the output interface 26 is an output circuit transmitting a signal for controlling the injectors 30 and the ignition coil 31.

The engine control unit 20 controls a fuel injection amount of the injectors 30 based on signals outputted by the respective sensors or the like, so as to control the air-fuel ratio.

Particularly, in order to improve fuel consumption, there may be a case where the engine is desired to be operated with the predetermined air-fuel ratio on the lean side from the logical air-fuel ratio (lean burn operation). However, due to dispersion of parts such as injectors for example, the actual air-fuel ratio may be displaced from the predetermined air-fuel ratio on the lean side. In this case, the $O_2$ sensor 48 is not able to detect what degree the actual air-fuel ratio is displaced from the predetermined air-fuel ratio on the lean side. Therefore, for example, when the actual air-fuel ratio is displaced on the rich side from the predetermined air-fuel ratio on the lean side for operating, it is difficult to improve fuel consumption.

Therefore, in this embodiment, first a target air-fuel ratio is brought to the logical air-fuel ratio, then feedback control is executed by using the $O_2$ sensor 48, and a learned value which will be described later for correcting the actual air-fuel ratio to be the target air-fuel ratio is calculated while the feedback correction coefficient is calculated. Next, open-loop control can be performed by applying the calculated learned value to thereby accurately control the actual air-fuel ratio to be the predetermined air-fuel ratio on the lean side, and thus operation with improved fuel consumption can be performed.

Further, for example, after the learned value is calculated, the outboard motor 10 is mounted on a different hull or alcohol-mixed gasoline is used instead of genuine gasoline in some cases. In such cases, even when the air-fuel ratio is controlled with the learned value which is learned previously, the actual air-fuel ratio is displaced from the predetermined air-fuel ratio on the lean side. Normally, mounting of the outboard motor 10 or filling of fuel is performed while the engine 12 is stopped, and thus in this embodiment, when a predetermined condition is satisfied first after the engine is started, the learned value is calculated again, and the open loop control is performed by applying the calculated learned value, thereby controlling the actual air-fuel ratio to be the predetermined air-fuel ratio on the lean side corresponding to a different use environment or fuel.

Hereinafter, the above-described air-fuel ratio control will be described specifically.

First, in this embodiment, the fuel injection amount when the air-fuel ratio control is performed is calculated with following Equation (1).

$$\text{Fuel injection amount } Ti = \text{basic fuel injection amount } TP \times (1 + \text{feedback correction coefficient } \alpha + \text{learned value } \alpha' + \text{various correction coefficient Coef}) \quad \text{Equation (1)}$$

Here, the basic fuel injection amount TP is a value calculated based on the intake pipe pressure detected by the intake pipe pressure sensor 43, and is corrected by an intake air temperature, an atmospheric pressure, and so on. That is, a value corresponding to the current operating state is applied.

The feedback correction coefficient α is a value calculated based on an output of the $O_2$ sensor 48 when the feedback control is performed, and becomes $\alpha=0$ when the open loop control is performed. For example, a value of −0.25 to 0.25 is applied to the feedback correction coefficient α.

The learned value α' is a value calculated based on the output of the feedback correction coefficient α calculated when the feedback control is performed, and is substituted both when the feedback control is performed and when the open loop control is performed. For example, a value of −0.02 to 0.12 is applied to the learned value α'.

The various correction coefficient Coef is a coefficient corrected under the condition when the engine 12 is started, idled, accelerated, decelerated, or the like. For example, a value of −0.20 to 0.20 is applied to the various correction coefficient Coef.

Figure 4:
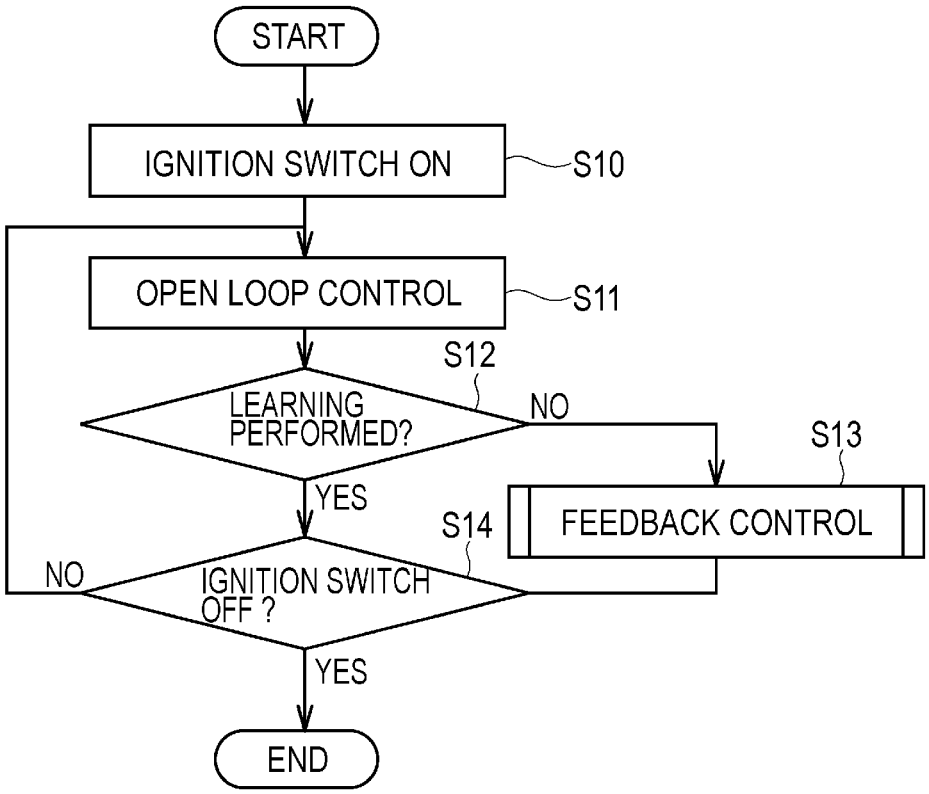
FIG. 4 is a main flowchart illustrating processing of air-fuel ratio control.
Figure 5:
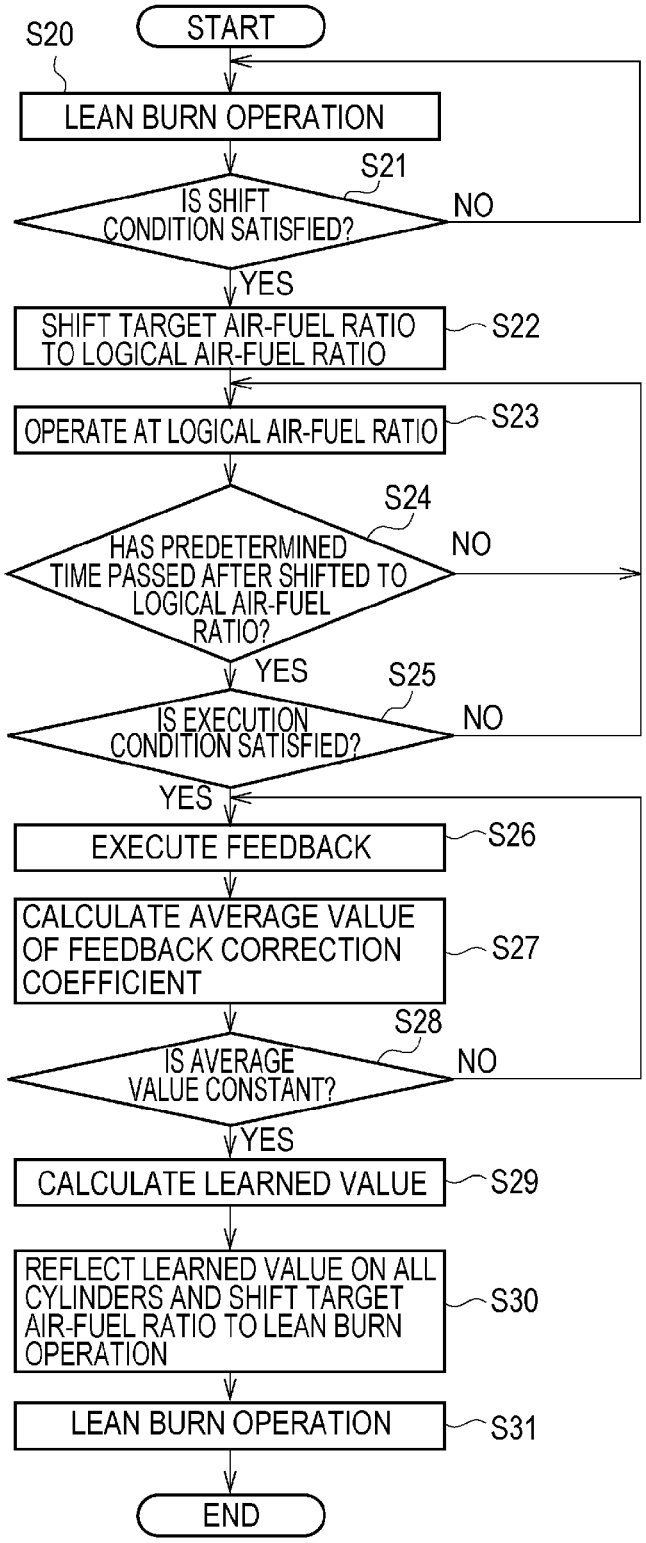
FIG. 5 is a flowchart illustrating processing of feedback control.
Figure 6:
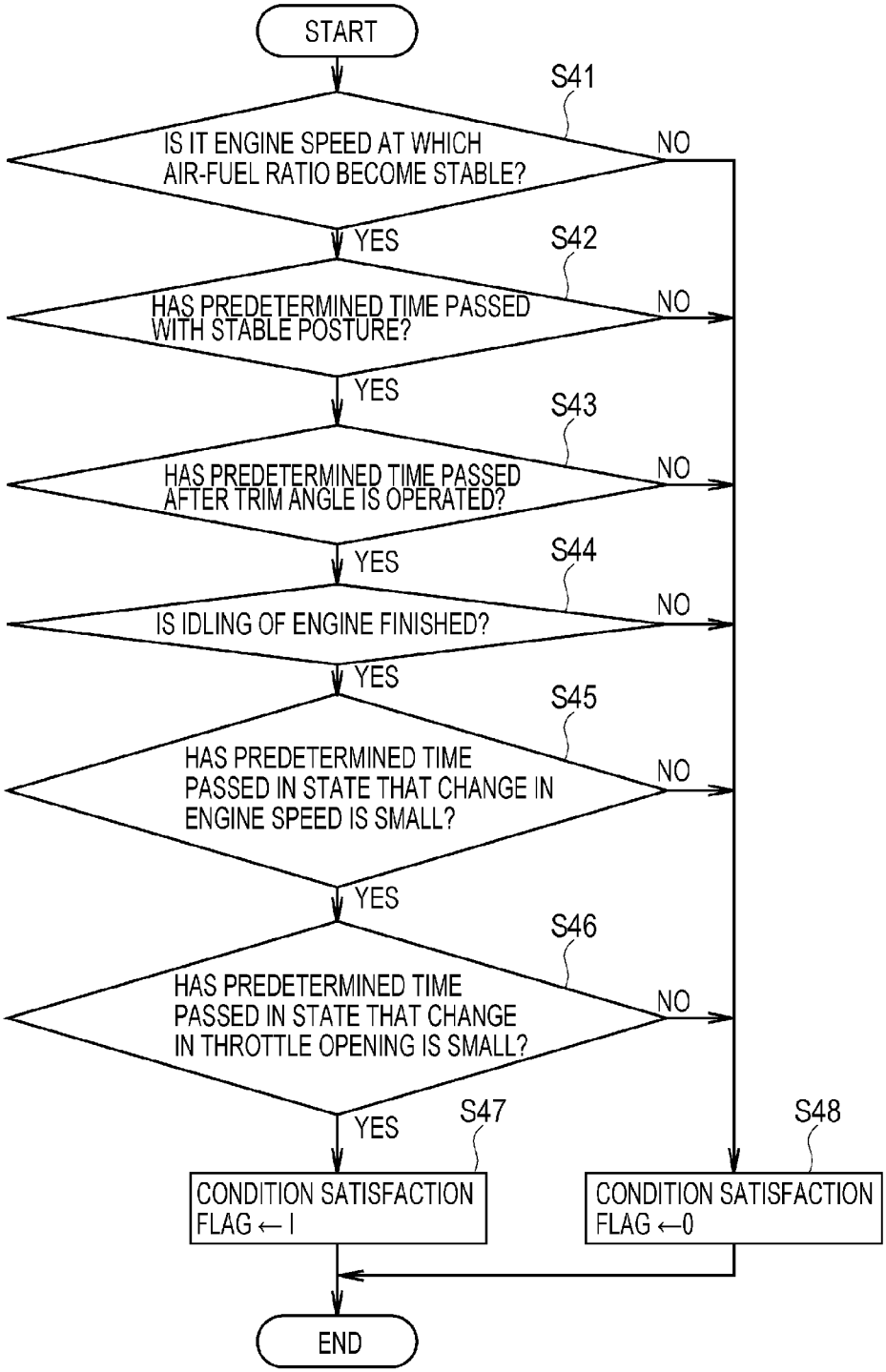
FIG. 6 is a flowchart for determining a condition to proceed to next processing in the feedback control.
Figure 7:
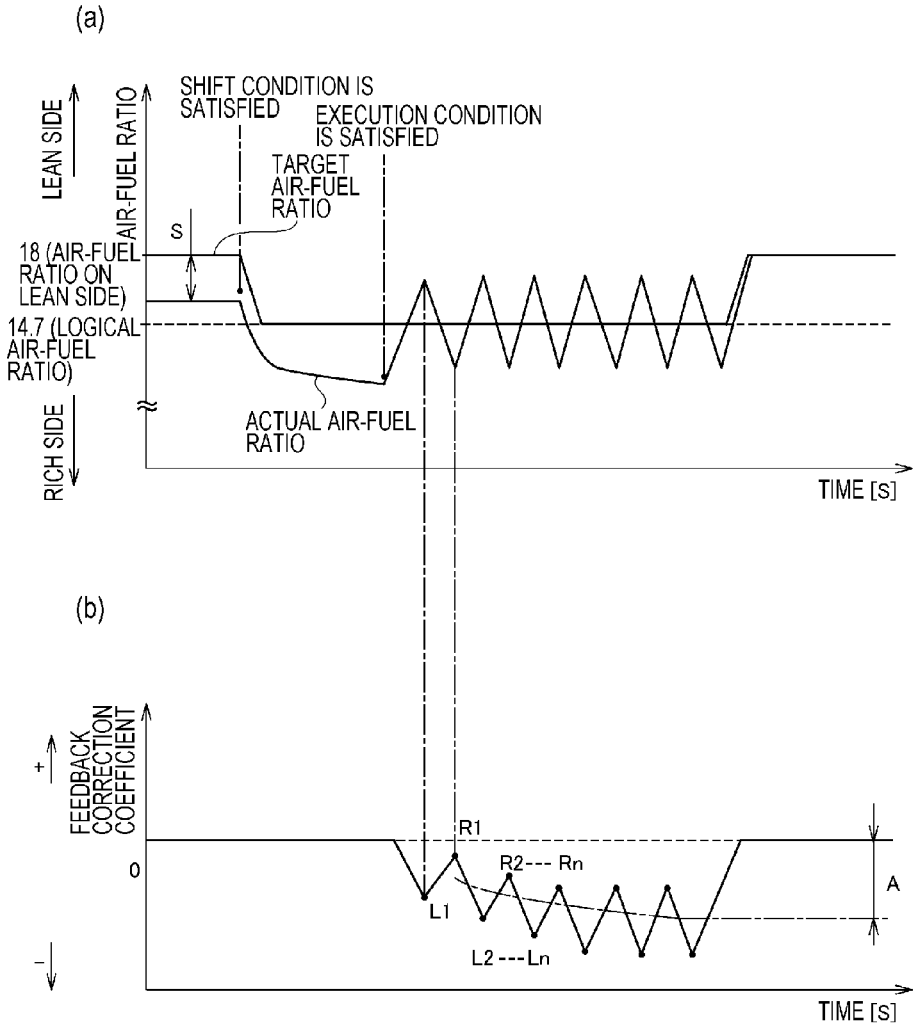
FIG. 7 is a diagram illustrating contents of the feedback control by graphs.

Hereinafter, processing performed by the engine control unit 20 will be described with reference to FIG. 4 to FIG. 7. FIG. 4 is a main flowchart illustrating processing of air-fuel ratio control. FIG. 5 is a flowchart illustrating processing of feedback control. FIG. 6 is a flowchart for determining a condition to proceed to the next processing in the feedback control. FIG. 7 is a diagram illustrating contents of the feedback control by graphs. Note that the flowcharts illustrated in FIG. 4 to FIG. 6 are realized by the CPU 21 of the engine control unit 20 executing the program product stored in the ROM 22.

First, in step S10, by turning on the ignition switch 46 by the boat operator, the CPU 21 performs control to supply power to respective devices, thereby starting the engine 12.

The CPU 21 reads the program product stored in the ROM 22 into the RAM 23, and starts processing of air-fuel ratio control based on the program product.

In step S11, when main processing is performed for the first time after the engine is started, the CPU 21 reads the learned value α' which is stored in the EEPROM 24 when the engine 12 is turned off in the previous operation, and stores the learned value in the RAM 23. The CPU 21 substitutes the learned value α' stored in the RAM 23 into above-described Equation (1) and substitutes the feedback correction coefficient α=0 into Equation (1) to calculate the fuel injection amount, and controls the air-fuel ratio by the open-loop control. At this time, the basic injection amount TP is calculated based on the intake pipe pressure detected by the intake pipe pressure sensor 43 as described above, the engine speed, and so on. The intake pipe pressure varies according to the operating state, and thus the CPU 21 calculates the fuel injection amount Ti according to the operating state and the learned value α' stored in the RAM 23, and controls the air-fuel ratio by the open loop control. Note that when the engine 12 is operated for the first time after it is purchased, the learned value α' of initial value stored in the EEPROM 24 can be applied.

In step S12, the CPU 21 determines whether the learned value α' is rewritten from the previous learned value or not since the engine 12 is started this time, that is, whether the learned value is learned again or not. Specifically, the CPU 21 reads a learning completion flag Ff stored in the RAM 23 for determining this. When the learning is already completed and the learning completion flag Ff is 1, the processing proceeds to step S14, or when the learning is not completed and the learning completion flag Ff is 0, the processing proceeds to step S13.

In step S13, the CPU 21 performs feedback control which will be described later, and rewrites and updates the learned value α' read from the RAM 23 to the learned value learned this time. That is, the CPU 21 re-learns the learned value α' corresponding to a use environment or fuel of the engine 12 at the present moment. Re-learning of the learned value α' in this manner is performed because the outboard motor 10 may be mounted on a hull 1 different from the previous time or alcohol-mixed gasoline may be filled as the fuel before the ignition switch 46 is turned on. The processing of step S13 will be described later with reference to the flowchart of FIG. 5.

In step S14, the CPU 21 determines whether the ignition switch 46 is turned off or not by the boat operator. When it is turned off, the CPU 21 stores the learned value α' stored in the RAM 23 in the EEPROM 24 and stops supply of power to respective devices, and stops the engine 12. Here, even when the supply of power is stopped, storing the learned value α' in the EEPROM 24 enables the CPU 21 to read the learned value α' from the EEPROM 24 in step S11 when the engine 12 is started next time.

When the ignition switch 46 is not turned off, the CPU 21 returns the processing to step S11 and performs the open loop control by using the learned value α' stored in the RAM 23, and thereby the air-fuel ratio can be controlled to be the target air-fuel ratio.

Next, the feedback control in step S13 described above will be described with reference to the flowchart illustrated in FIG. 5 and the graphs describing a control method of air-fuel ratio illustrated in FIG. 7.

First, in step S20, the CPU 21 performs operation by setting a predetermined air-fuel ratio on the lean side as the target air-fuel ratio for all the cylinders (#1 to #6) (lean burn operation). Note that in this embodiment, 18 is applied as the predetermined air-fuel ratio on the lean side.

Specifically, in step S20, the CPU 21 substitutes the learned value α' stored in the RAM 23 into above-described Equation (1) and substitutes the feedback correction coefficient α=0 into Equation (1) to calculate the fuel injection amount, and performs control to bring the target air-fuel ratio to 18 by the open loop control. Here, the learned value α' stored in the RAM 23 is a learned value stored when the engine is started previously, and thus when the use environment or fuel is different due to mounting on a different hull or filling alcohol-mixed gasoline this time, the actual air-fuel ratio is displaced from the target air-fuel ratio.

FIG. 7(*a*) is a graph illustrating a variation of the actual air-fuel ratio relative to the target air-fuel ratio, and FIG. 7(*b*) is a graph illustrating a deviation of the feedback correction coefficient. Here it is assumed that, as illustrated in FIG. 7(*a*), the actual air-fuel ratio is displayed by S from the target air-fuel ratio.

As described above, the $O_2$ sensor 48 can only detect whether the actual air-fuel ratio is on the lean side or the rich side of the logical air-fuel ratio, and cannot detect what degree the actual air-fuel ratio is displaced from the predetermined air-fuel ratio on the lean side, that is, the value of S illustrated in FIG. 7(*a*). Accordingly, the CPU 21 changes the target air-fuel ratio to the logical air-fuel ratio, detects the actual air-fuel ratio by the $O_2$ sensor 48, and executes the feedback control to correct the displacement of the actual air-fuel ratio from the target air-fuel ratio.

In step S21, the CPU 21 determines whether a predetermined condition is satisfied or not, which will be described below, before shifting the target air-fuel ratio to the logical air-fuel ratio. Specifically, the CPU 21 reads a shift condition satisfaction flag Fa stored in the RAM 23 for performing determination. When the shift condition is satisfied and the shift condition satisfaction flag Fa is 1, the processing proceeds to step S22, or when the shift condition is not satisfied and the shift condition satisfaction flag Fa is 0, the processing waits until the shift condition is satisfied.

Next, a method of determining a satisfaction condition in above-described step S21 will be described with reference to the flowchart illustrated in FIG. 6.

First, in step S41, the CPU 21 determines whether or not the current engine speed is an engine speed at which the air-fuel ratio becomes stable. When it is the engine speed at which the air-fuel ratio becomes stable, the processing proceeds to step S42, or when this condition is not satisfied, the processing proceeds to step S48. In step S48, the shift condition satisfaction flag Fa is changed to 0 and stored in the RAM 23, and the target air-fuel ratio is not shifted to the logical air-fuel ratio. The determination as in step S41 is performed because when the engine speed is high or when it is low, the air-fuel ratio does not become stable, and accurate feedback control is not possible. In step S41, whether the engine speed is, for example, more than or equal to 2000 rpm and less than or equal to 4000 rpm, or the like is determined based on a threshold stored in the ROM 22.

In step S42, the CPU 21 determines whether or not a predetermined time has passed while the outboard motor 10 is in a stable posture. Specifically, the CPU 21 determines whether the predetermined time has passed or not while the outboard motor 10 is in a stable posture based on a signal outputted by the posture meter 49. When the predetermined time has passed while the outboard motor 10 is in a stable posture, the processing proceeds to step S43, or when the condition is not satisfied, the processing proceeds to step S48 where the shift condition satisfaction flag Fa is changed to 0 and stored in the RAM 23. The determination as in step S42 is performed because, for example, when the hull 1 is planing as before becoming a planing state and the posture of the hull 1 has changed, the engine speed and the air-fuel ratio change, and it is not possible to perform accurate feedback control. Note that it is not limited to the case where the posture of the hull 1 is detected with the posture meter, and whether a predetermined time has passed or not while the throttle opening and engine opening are constant may be determined.

In step S43, the CPU 21 determines whether a predetermined time has passed or not after an operation of changing the trim angle β of the outboard motor 10 by the boat operator is performed. Specifically, the CPU 21 determines whether the trim angle β of the outboard motor 10 is changed or not based on the signal outputted by the tilt and trim angle sensor 47. When the predetermined time has passed after the operation of changing the trim angle β of the outboard motor 10 is performed, the processing proceeds to step S44, or when the condition is not satisfied, the processing proceeds to step S48 where the shift condition satisfaction flag Fa is set to 0 and stored in the RAM 23. The determination as in step S43 is performed because when the operation of changing the trim angle β is performed, the posture of the outboard motor 10 changes and the engine speed and the air-fuel ratio change, and it is not possible to perform accurate feedback control.

In step S44, the CPU 21 determines whether the engine 12 is in an idling operation or not. Specifically, the CPU 21 determines whether or not it is a temperature more than or equal to a threshold stored in the ROM 22 for example, based on the signal outputted by the cylinder wall temperature sensor 44. When it is not in the idling operation, the processing proceeds to step S45, or when it is in the idling operation, the processing proceeds to step S48 where the shift condition satisfaction flag Fa is set to 0 and stored in the RAM 23. The determination as in step S44 is performed because in the case of the idling operation, the engine is operated at a richer air-fuel ratio than the logical air-fuel ratio to prioritize the safety of operation in a cold state, and the feedback control by detection by the $O_2$ sensor 48 is stopped.

Note that in the case of a water-cooled engine as in this embodiment, the temperature of the above-described threshold can be set to a value corresponding to the opening temperature of a thermostat (not illustrated). Thus, in some cases, a thermostat with a high opening temperature is used in the engine 12 specific to cold region, and in such cases, the temperature of the threshold is set high according to the opening degree of the thermostat. By setting the temperature of the threshold in this manner, the feedback control with a stable air-fuel ratio can be performed.

In step S45, the CPU 21 determines whether a predetermined time has passed or not in a state that a change in the engine speed is small. Specifically, the CPU 21 detects the engine speed by counting the signal outputted by the crank angle sensor 41, and determines whether a change in the engine speed is small or not. When the predetermined time has passed in a state that the change in the engine speed is small, the processing proceeds to step S46, or when the condition is not satisfied, the processing proceeds to step S48 where the shift condition satisfaction flag Fa is set to 0 and stored in the RAM 23. The determination as in step S45 is performed because when the change in the engine rotation speed is large such as when accelerating or decelerating, the air-fuel ratio changes, and accurate feedback control cannot be performed.

In step S46, the CPU 21 determines whether a predetermined time has passed or not in a state that a change in the throttle opening is small. Specifically, the CPU 21 determines whether a change in the throttle opening per unit time is small or not based on the signal outputted by the throttle opening sensor 42. When the predetermined time has passed in a state that the change in the throttle opening is small, the processing proceeds to step S47, or when the condition is not satisfied, the processing proceeds to step S48, where the shift condition satisfaction flag Fa is set to 0 and stored in the RAM 23. The determination as in step S46 is performed because when the change in the throttle opening is large, the air-fuel ratio changes, and accurate feedback control cannot be performed.

In step S47, the above described predetermined conditions of respective steps are satisfied, and the engine 12 is in a state of being able to perform accurate feedback control. Thus, the CPU 21 sets the shift condition satisfaction flag Fa to 1 and stores it in the RAM 23, and returns to the processing of step S21 illustrated in FIG. 5.

As described above, in step S21, when the shift condition satisfaction flag Fa is 1, the CPU 21 proceeds to step S22.

In step S22, the CPU 21 shifts the target air-fuel ratio to the logical air-fuel ratio 14.7 from a state that the operation is performed with the target air-fuel ratio being in the vicinity of the predetermined air-fuel ratio 18 on the lean side. In this embodiment, the CPU 21 shifts to the logical air-fuel ratio only part of the six cylinders (#1 to #6), namely, the cylinders (#2, #4, #6) of the left bank 15 on which the $O_2$ sensor 48 is disposed. At this moment, the CPU 21 performs operation to increase the basic injection amount TP while keeping the feedback correction coefficient $\alpha=0$, so that the fuel injection amount Ti increases and the target air-fuel ratio becomes the logical air-fuel ratio 14.7. Note that at this moment the CPU 21 varies the basic injection amount TP while the previous learned value is kept substituted for the learned value α' in Equation (1).

In step S23, the CPU 21 continues the operation while the target air-fuel ratio is kept to be the logical air-fuel ratio as it is. Note that as illustrated in FIG. 7(*a*), even when the target air-fuel ratio is changed to the logical air-fuel ratio, operation is performed with the value of the learned value α' being the learned value stored at the time of previous start of the engine 12, and thus the actual air-fuel ratio is displaced from the logical air-fuel ratio.

In step S24, the CPU 21 determines whether the predetermined time has passed or not since the target air-fuel ratio is shifted to the logical air-fuel ratio. When the predetermined time has passed, the processing proceeds to step S25, or when the predetermined time has not passed, the processing returns to step S23 and waits for the predetermined time to pass. The processing as in step S24 is performed because, as illustrated in FIG. 7(*a*), after the shift condition is satisfied, there is a time lag from when the target air-fuel ratio is shifted to the logical air-fuel ratio until when the actual air-fuel ratio becomes a constant air-fuel ratio. Note that a time according to the current engine speed is applied to the predetermined time here.

In step S25, the CPU 21 determines whether a predetermined condition is satisfied or not before shifting to the feedback control. Specifically, the CPU 21 reads an execution condition satisfaction flag Fb stored in the RAM 23 for performing determination. When the execution condition is satisfied and the execution condition satisfaction flag Fb is 1, the processing proceeds to step S26, or when the execution condition is not satisfied and the execution condition satisfaction flag Fb is 0, the processing waits until the execution condition is satisfied.

The method of determining a satisfaction condition in step S25 is similar to the flowchart illustrated in FIG. 6 described above, and a detailed description is omitted. Here, as explained in the processing from step S41 to step S46 described above, when the predetermined condition is satisfied and the current operating state of the engine 12 allows the accurate feedback control, the processing proceeds to step S47, where the CPU 21 substitutes 1 into the execution condition satisfaction flag Fb and stores it in the RAM 23. On the other hand, when it is not possible to perform the accurate feedback control, the processing proceeds to step S48 where the CPU 21 substitutes 0 into the execution condition satisfaction flag Fb, and stores it in the RAM 23. Thereafter, the processing returns to step S25. Thus, the accurate feedback control can be performed by executing the feedback control only when the execution condition is satisfied.

As described above, in step S25, the CPU 21 proceeds the processing to step S26 when the execution condition is satisfied and the execution condition satisfaction flag Fb is 1.

In step S26, the CPU 21 executes the feedback control. In this embodiment, the CPU 21 performs the feedback control only on part of the six cylinders (#1 to #6), namely, the cylinders (#2, #4, #6) of the left bank 15 on which the $O_2$ sensor 48 is disposed.

Specifically, as illustrated in FIGS. 7(*a*) and (*b*), when the $O_2$ sensor 48 detecting the current air-fuel ratio outputs a signal on the rich side from the logical air-fuel ratio, the CPU 21 decreases the feedback correction coefficient $\alpha$ to control the air-fuel ratio to be on the lean side. Inversely, when the $O_2$ sensor 48 outputs a signal on the lean side from the logical air-fuel ratio, the CPU 21 increases the feedback correction coefficient $\alpha$ to control the air-fuel ratio to be on the rich side. By repeating such processing, as illustrated in FIG. 7(*b*), decrease and increase of the value of the feedback correction coefficient $\alpha$ are repeated alternately. Further, as illustrated in FIG. 7(*a*), reversing of the actual air-fuel ratio is repeated alternately between the rich side and the lean side about the logical air-fuel ratio, and the feedback control is performed. Note that at this moment, the CPU 21 varies the feedback correction coefficient $\alpha$ while the previous learned value is kept substituted for the learned value $\alpha'$ in Equation (1). Thus, by varying the feedback correction coefficient $\alpha$ in a state that the previous learned value is applied, the previous learning can be utilized, and thus variation of the feedback correction coefficient $\alpha$ can be decreased. That is, decreasing variation of the feedback correction coefficient $\alpha$ means that variation of the fuel injection amount Ti also decreases, and consequently variations in the behavior of the engine 12 can be decreased.

Note that when the alcohol-mixed gasoline is filled as the fuel, the logical air-fuel ratio becomes a value smaller than 14.7 as the concentration of alcohol becomes higher. However, since the $O_2$ sensor 48 is able to output whether the actual air-fuel ratio is on the rich side or the lean side from the logical air-fuel ratio corresponding to the concentration of alcohol, reversing of the actual air-fuel ratio is repeated alternately between the rich side and the lean side about the logical air-fuel ratio corresponding to the concentration of alcohol similarly to the graph illustrated in FIG. 7(*a*), and the feedback control is performed. That is, when the alcohol-mixed gasoline is filled as the fuel, the feedback control is performed so as to correct the displacement between the actual air-fuel ratio and the target logical air-fuel ratio due to both the different use environment and the fuel.

Next, in step S27, the CPU 21 samples feedback correction coefficients at the time the actual air-fuel ratio reverses from the rich side to the lean side and feedback correction coefficients at the time the actual air-fuel ratio reverses from the lean side to the rich side, and stores them in the RAM 23. Specifically, as illustrated in FIG. 7(*b*), it is assumed that, for example, the feedback coefficients at the time of reversing of the rich side are R1, R2, . . . , Rn, respectively, and the feedback coefficients at the time of reversing of the lean side are L1, L2, . . . , Ln, respectively. In this case, the CPU 21 stores the respective feedback correction coefficients (R1, R2, . . . , Rn and L1, L2, . . . , Ln) in the RAM 23.

The CPU 21 calculates the average value of feedback coefficients from a predetermined number of past feedback correction coefficients stored in the RAM 23, and stores the calculated average value in the RAM 23. Specifically, the average value calculated first in step S27 is calculated by using following Equation (2).

$$\text{Average value } A=(R1+R2+\ldots+Rn+L1+L2+\ldots+Ln)/2\times n \qquad \text{Equation (2)}$$

Every time the CPU 21 samples the feedback correction coefficient when the air-fuel ratio is reversed, the CPU newly calculates the average value from the predetermined number of past feedback correction coefficients, and stores the calculated average value in the RAM 23.

For example, when the predetermined number is 10 and the processing proceeds to step S27 for the first time, the CPU 21 calculates an average value A1 from a total of ten feedback correction coefficients of R1 to R5, L1 to L5. Then, after branched to NO in step S28 which will be described later, when proceeded to step S27 for the second time, the CPU 21 samples the feedback correction coefficient of L6, and calculates an average value A2 from a total of ten feedback correction coefficients of R1 to R5, L2 to L6. Thereafter, similarly, when proceeded to step S27 for the third time, the CPU 21 samples the feedback correction coefficient of R6, and calculates an average value A3 from a total of ten feedback correction coefficients of R2 to R6, L2 to L6. Thus, in step S27, the CPU 21 calculates the average value A by using up to a predetermined number of past feedback correction coefficients which is counted from the latest feedback correction coefficient.

Next, in step S28, the CPU 21 determines whether the average value A calculated in step S27 has become substantially constant or not. Specifically, the CPU 21 determines whether the average value has become substantially constant or not by comparing it with the average value calculated in step S27 which is calculated one time before this time (previously). For example, in step S27, when the above-described average value A2 is calculated, it is compared with the average value A1 calculated one time before that. When the average value A2 and the average value A1 are substantially the same, the CPU 21 determines that the average value A has become substantially constant.

Note that specifically the determination of whether the average value is substantially constant or not may be such that the average value calculated previously is subtracted from the average value calculated this time, and when this value is smaller than a predetermined value, the average value is determined to be substantially constant, or may be such that a change ratio of the average value calculated this time is calculated from the average value calculated previously, and when this change ratio is lower than a predetermined change ratio, the average value is determined to be substantially constant.

Thus, whether this average value A has become substantially constant or not is determined in this manner is because, as illustrated by a chain-dashed line in FIG. 7(*b*), the average value of feedback correction coefficients at the time of reverse becomes gradually constant after the feedback control is executed.

When the average value A has become substantially constant, the processing proceeds to step S29. On the other hand, when the average value A has not become substantially constant, the CPU 21 repeats the feedback control by step S26 and the calculation of the average value of feedback correction coefficients by step S27 until the average value becomes substantially constant.

Note that when the average value of feedback correction coefficients is calculated, it is also conceivable to add processing to determine whether the above-described condition as illustrated FIG. 6 is satisfied or not, and after this condition is satisfied, the feedback correction coefficient is sampled to calculate the average value of feedback correction coefficients. However, the time at which the average value A of the feedback correction coefficient becomes substantially constant differs also depending on the engine speed or the like. Therefore, to calculate the accurate average value of feedback correction coefficients, it is necessary to set a time at which the average value becomes substantially constant for all the engine speeds. That is, although the average value A has become substantially constant, it is necessary to wait until that condition is satisfied, and hence it takes time for the average value A to be calculated.

On the other hand, as in this embodiment, by determining whether the average value A has become substantially constant or not and using the average value A when it has become substantially constant in the next processing, the learned value can be calculated accurately in a short time.

Next, in step S29, the CPU 21 adds the average value A which became substantially constant to the previous learned value α' to thereby calculate a new learned value α' as in Equation (3).

$$\text{New learned value } \alpha' = (\text{previous learned value } \alpha' + \text{average value } A) \qquad \text{Equation (3).}$$

At this point, the learned value is re-learned, and the previous learned value α' is rewritten and updated by the new learned value α' calculated this time by Equation (3). That is, the CPU 21 stores the new learned value α' in the RAM 23. Further, the CPU 21 substitutes 1 into the learning completion flag Ff and stores it in the RAM 23.

By using the new learned value α' stored in the RAM 23 to calculate the fuel injection amount Ti, the displacement between the target air-fuel ratio corresponding to the current use environment and the fuel and the actual air-fuel ratio can be corrected.

In step S30, the CPU 21 applies the updated new learned value α' to all the cylinders, that is, the six cylinders (#1 to #6), changes the target air-fuel ratio to the predetermined air-fuel ratio on the lean side, and shifts to the open loop control. Specifically, the CPU 21 substitutes the feedback correction coefficient α=0 into above-described Equation (1) and substitutes the re-learned learned value α' in Equation (1), to thereby calculate the fuel injection amount Ti so that the target air-fuel ratio becomes the predetermined air-fuel ratio on the lean side for performing operation.

As illustrated in FIG. 7(*a*), by applying the learned value α' which is re-learned, the actual air-fuel ratio can be matched with the predetermined air-fuel ratio on the lean side which is the target.

Therefore, it is possible to correct the displacement between the actual air-fuel ratio and the target logical air-fuel ratio due to the different use environment or fuel, not being limited to dispersion of parts, and the actual air-fuel ratio can be matched with the target predetermined air-fuel ratio on the lean side accurately in a short time.

In step S31, thereafter, the CPU 21 applies the learned value α' described in step S30, and continues the operation with the predetermined air-fuel ratio on the lean side.

Thereafter, the processing returns to the above-described main flowchart illustrated in FIG. 4, and in step S14, when the ignition switch 46 is turned off, the CPU 21 stores in the EEPROM 24 the re-learned value α' which is stored in the RAM 23 in step S29, so that the learned value can be applied when the engine 12 is started next time.

Figure 8:
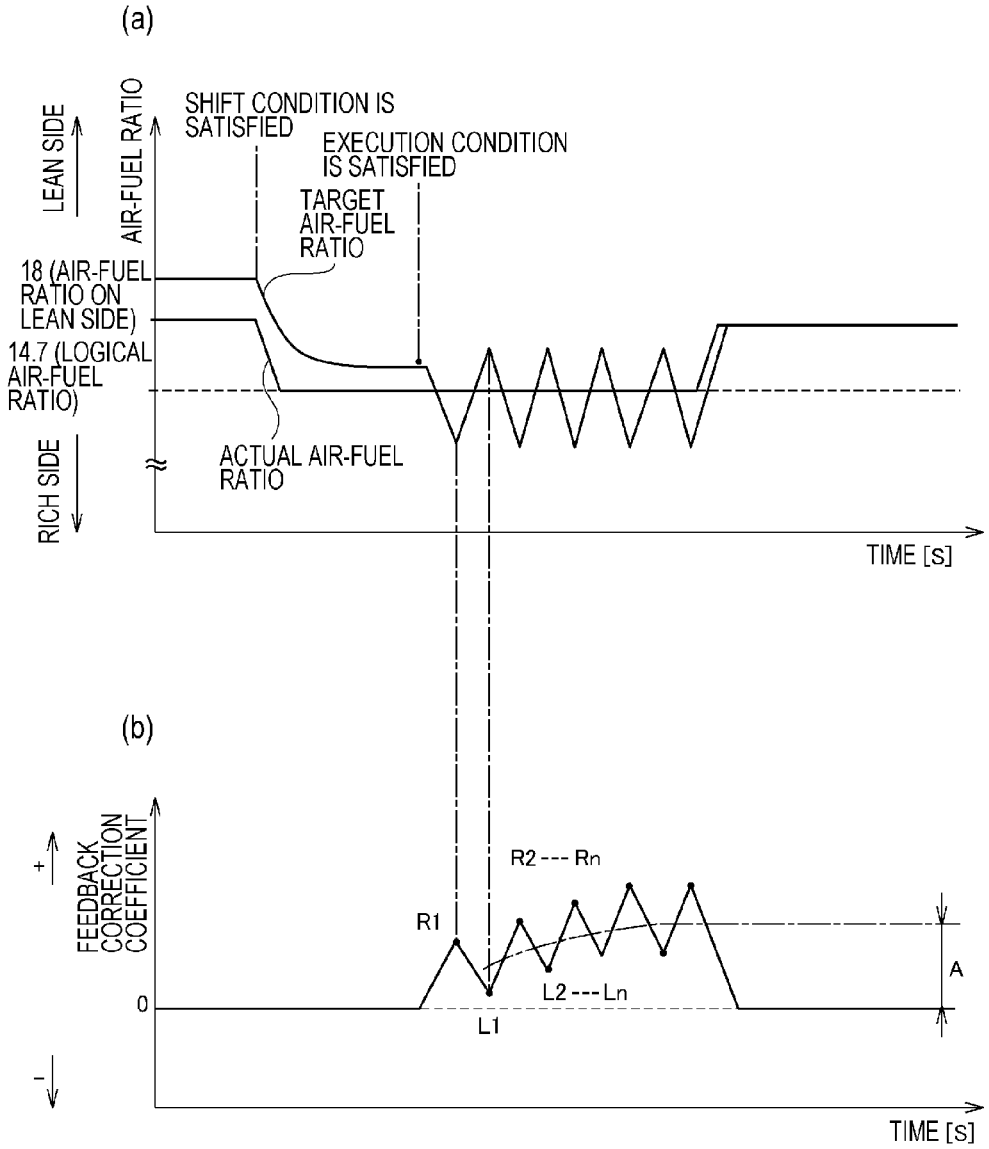
FIG. 8 is a diagram illustrating contents of the feedback control by graphs.

Note that in the above-described description, the case where the actual air-fuel ratio is displaced to the rich side from the target air-fuel ratio was explained as an example as in the graph illustrating the contents of the feedback control of FIG. 7. However, it is not limited to this case, and as in the graph illustrating the contents of the feedback control of FIG. 8, the actual air-fuel ratio is displaced to the lean side from the target air-fuel ratio in some cases for example, when the fuel is changed from genuine gasoline to alcohol-mixed gasoline, or the like). FIG. 8(*a*) is a graph illustrating a variation of the actual air-fuel ratio relative to the target air-fuel ratio, and FIG. 8(*b*) is a graph illustrating a deviation of the feedback correction coefficient. Also in this case, the displacement between the actual air-fuel ratio and the target logical air-fuel ratio due to the different use environment or fuel can be corrected similarly, and the actual air-fuel ratio can be matched with the target predetermined air-fuel ratio on the lean side accurately in a short time.

Note that the displacement of the actual air-fuel ratio from the target air-fuel ratio occurs according to an engine operating range in some cases. Thus, the CPU 21 may divide the engine operating range in which the open loop control is performed (here, an engine speed range is used) into plural zones, and may learn the learned value α' in each zone.

Figure 9:
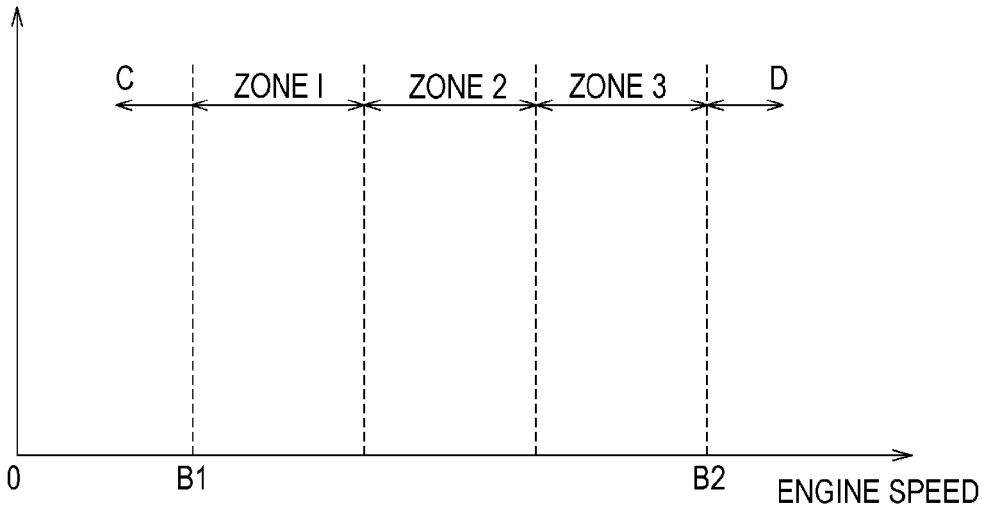
FIG. 9 is a diagram for explaining dividing of an engine speed range into zones.

That is, as illustrated in FIG. 9, the lean burn operation by the open loop control is executed when the engine speed is in a predetermined engine speed range B1 to B2. Here, the engine speed range B1 to B2 is divided into, for example, a zone 1 (low rotation speed range), a zone 2 (middle rotation speed range), and a zone 3 (high rotation speed range), and the learned value α' is set in each zone.

By performing processing of step S20 to step S31 illustrated in FIG. 5 in each zone to calculate the learned value α' corresponding to each zone, and applying the calculated learned value α' in each zone to perform the open loop control, the CPU 21 can accurately correct a displacement of the air-fuel ratio which occurs according to the engine speed range.

Note that the CPU 21 performs the open loop control by applying the learned value α' calculated in the zone 1 in an engine speed range (C illustrated in FIG. 9) lower than the zone 1. This is because there is large dispersion of the engine speed in the engine speed range which is lower than the zone 1, and it is difficult to calculate an accurate learned value α'.

Further, the CPU 21 performs the open loop control by applying the learned value α' calculated in the zone 3 in an engine speed range higher than the zone 3. This is because it is difficult to change the air-fuel ratio to the logical air-fuel ratio in the engine speed range (D illustrated in FIG. 9) which is higher than the zone 3, and it is difficult to perform the feedback control.

Therefore, it is preferred that the zone 1 be set from a stable engine speed, and that the zone 3 be set up to an engine speed at which the air-fuel ratio can be changed to the logical air-fuel ratio. Further, dividing into zones is set so that a difference in load variation in each zone comes within a predetermined range. Note that the number of zones is not limited, and when the learned value is set with finely divided zones for example, a displacement of the air-fuel ratio which occurs according to the engine speed can be corrected with accordingly high accuracy.

As described above, in the present invention, whether the average value of feedback correction coefficients at the time of reverse of the air-fuel ratio has become substantially constant is determined in the feedback control, and the average value at the time it became substantially constant is used to calculate the learned value. By such processing, an accurate average value of feedback correction coefficients can be calculated early, and the actual air-fuel ratio can be matched with the target air-fuel ratio in an accordingly short time without error. Therefore, the ratio (opportunity) of operating at the air-fuel ratio on the lean side can be increased, to thereby improve the fuel consumption.

Further, by using the predetermined number of feedback correction coefficients when the average value of feedback correction coefficients is calculated, it is possible to more accurately determine whether the average value of feedback correction coefficients has become substantially constant or not.

Further, according to this embodiment, costs of equipment can be reduced by changing the target air-fuel ratio to the logical air-fuel ratio and performing the feedback control using the $O_2$ sensor, and learning the displacement of the actual air-fuel ratio from the target air-fuel ratio.

Further, by learning the displacement of the air-fuel ratio from the target air-fuel ratio when the predetermined condition is satisfied for the first time after the engine is started, it is possible to calculate the learned value according to the use environment or fuel, without being limited to dispersion of parts, and consequently, the actual air-fuel ratio can be matched with the predetermined air-fuel ratio on the lean side which is the target.

Moreover, in this embodiment, after the learned value is calculated in part of the cylinders in one bank in the V engine, the learned value is reflected on all the cylinders. Thus, the CPU 21 can reduce the processing for calculating the learned value, and can calculate the learned value quickly.

In the foregoing, the present invention has been described with various embodiments, but the invention is not limited only to these embodiments, and changes or the like can be made within the scope of the present invention.

For example, in the above-described embodiments, the case of applying the V6 engine was described, but the invention is not limited to this. It may be a straight engine, or multi-cylinder engine other than the six-cylinder engine.

Further, in the above-described embodiments, the case of performing the feedback control on the three cylinders corresponding to the exhaust pipe on which the $O_2$ sensor 48 is disposed was described, but it is not restrictive. For example, only the cylinder #2 which is closest to the $O_2$ sensor 48 may be feedback controlled, and the result of the feedback control may be reflected on all the cylinders. By feedback controlling only one cylinder in this manner, the CPU 21 can calculate the learned value quickly.

Further, in this embodiment, the case where the CPU 21 executes the above-described processing by executing the program product has been described, but it is not restrictive, and respective circuits structured of hardware may execute the above-described processing.

According to the present invention, the displacement of the actual air-fuel ratio from the target air-fuel ratio can be corrected accurately in a short time, and thus the ratio (opportunity) of operating at the air-fuel ratio on the lean side can be increased, to thereby further improve the fuel consumption.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An air-fuel ratio control device which controls an air-fuel ratio of an internal combustion engine for an outboard motor provided with an $O_2$ sensor, which is disposed in an exhaust system of the internal combustion engine and varies in output characteristics in a vicinity of a logical air-fuel ratio, the air-fuel ratio control device comprising:

an open loop controller that controls the air-fuel ratio to be a target air-fuel ratio based on an operating state of the internal combustion engine and a learned value;

a feedback controller that shifts the target air-fuel ratio to a logical air-fuel ratio from a state that the target air-fuel ratio is controlled to be a predetermined air-fuel ratio on a lean side by the open loop controller, and feedback controls the air-fuel ratio to be the logical air-fuel ratio by using a feedback correction coefficient determined based on an output of the $O_2$ sensor;

an average value calculator that calculates the average value of the feedback correction coefficient when the output of the $O_2$ sensor reverses from a lean side to a rich side and from the rich side to the lean side in the feedback control by the feedback controller; and a learned value calculator that calculates the learned value based on an average value at a time when the average value calculated by the average value calculator becomes substantially constant, wherein the average value calculator calculates the average value by using a predetermined number of past feedback correction coefficients when the output of the $O_2$ sensor reverses from the lean side to the rich side and from the rich side to the lean side.

2. The air-fuel ratio control device according to claim 1, wherein when the average value of the predetermined number of past feedback correction coefficients calculated by the average value calculator becomes substantially the same as a previously calculated average value of a predetermined number of past feedback correction coefficients, the learned value calculator calculates the learned value based on the average value when the average value becomes substantially the same.

3. The air-fuel ratio control device according to claim 1, wherein when a change ratio between the average value of the predetermined number of past feedback correction coefficients calculated by the average value calculator and a previously calculated average value of a predetermined number of past feedback correction coefficients becomes lower than a predetermined change ratio, the learned value calculator calculates the learned value based on the average value when the change ratio becomes lower.

4. The air-fuel ratio control device according to claim 1, wherein the learned value calculator calculates a learned value in each of plural engine operating ranges.

5. The air-fuel ratio control device according to claim 4, wherein the engine operating ranges are set by using an engine speed range.

6. The air-fuel ratio control device according to claim 5, wherein the open loop controller controls the air-fuel ratio to be the target air-fuel ratio by using the learned value learned in a lowest low rotation speed range by the learned value calculator in an engine speed range which is lower than the low rotation speed range.

7. The air-fuel ratio control device according to claim 5, wherein the open loop controller controls the air-fuel ratio to be the target air-fuel ratio by using the learned value learned in a highest high rotation speed range by the learned value calculator in an engine speed range which is higher than the high rotation speed range.

8. An air-fuel ratio control method which controls an air-fuel ratio of an internal combustion engine for an outboard motor provided with an $O_2$ sensor, which is disposed in an exhaust system of the internal combustion engine and varies in output characteristics in a vicinity of a logical air-fuel ratio, the air-fuel ratio control method comprising:

an open loop control step of controlling the air-fuel ratio to be a target air-fuel ratio based on an operating state of the internal combustion engine and a learned value;

a feedback control step of shifting the target air-fuel ratio to a logical air-fuel ratio from a state that the target air-fuel ratio is controlled to be a predetermined air-fuel ratio on a lean side by the open loop control step, and feedback controlling the air-fuel ratio to be the logical air-fuel ratio by using a feedback correction coefficient determined based on an output of the $O_2$ sensor;

an average value calculating step of calculating an average value of the feedback correction coefficient when the output of the $O_2$ sensor reverses from a lean side to a rich side and from the rich side to the lean side in the feedback control step; and a learned value calculating step of calculating the learned value based on an average value at a time when the average value calculated by the average value calculating step becomes substantially constant, wherein in the average value calculating step, the average value is calculated by using a predetermined number of past feedback correction coefficients when the output of the $O_2$ sensor reverses from the lean side to the rich side and from the rich side to the lean side.

* * * * *